United States Patent [19]

Greene

[11] Patent Number: 4,506,269

[45] Date of Patent: Mar. 19, 1985

[54] LAMINATED THERMOPLASTIC RADOME

[75] Inventor: Edward E. Greene, Barton, N.Y.

[73] Assignee: The United States of America as represented by the Secretary of the Air Force, Washington, D.C.

[21] Appl. No.: 382,070

[22] Filed: May 26, 1982

[51] Int. Cl.[3] ..... H01Q 1/42

[52] U.S. Cl. ..... 343/872

[58] Field of Search ..... 343/872, 909, 911 R

[56] References Cited

U.S. PATENT DOCUMENTS

| | | | |
|---|---|---|---|
| 2,956,281 | 10/1960 | McMillan et al. | 343/872 |
| 3,082,510 | 3/1963 | Kelly et al. | 29/155.5 |
| 3,292,544 | 12/1966 | Caldwell et al. | 102/92.5 |
| 3,432,859 | 3/1969 | Jordan et al. | 343/872 |
| 3,545,146 | 12/1970 | Kerr | 52/80 |
| 3,780,374 | 12/1973 | Shibano et al. | 343/872 |
| 3,806,928 | 4/1974 | Costanza | 343/872 |
| 3,871,001 | 3/1975 | Myers | 343/872 |
| 4,148,039 | 4/1979 | Lunden | 343/872 |
| 4,173,187 | 11/1979 | Steverding | 343/872 |
| 4,179,699 | 12/1979 | Lunden | 343/872 |
| 4,358,772 | 11/1982 | Leggett | 343/872 |

OTHER PUBLICATIONS

Metzger; Lightweight Ceramics for Radomes; Ceramic Industries, Jun. 1957, pp. 122, 123 and 135.

*Primary Examiner*—Eli Lieberman

*Attorney, Agent, or Firm*—Donald J. Singer; Stanton E. Collier

[57] ABSTRACT

An improved rain resistance radome C-sandwich wall is constructed of thermoplastic polycarbonate material. The cores are either posts or tubes and are bonded to the skins with polyurethane. The percentage of core material to air is adjusted by electrical tuning to make the optimum dielectric value for use in the gigahertz radar frequency range.

6 Claims, 5 Drawing Figures

LAMINATED THERMOPLASTIC RADOME

STATEMENT OF GOVERNMENT INTEREST

The invention described herein may be manufactured and used by or for the Government for governmental purposes without the payment of any royalty thereon.

BACKGROUND OF THE INVENTION

This invention relates generally to radomes, and, in particular to radomes attached to supersonic aircraft. Of particular concern is the ability of these radomes to have a greater field life in hostile rain impact environments.

As rain impacts on a radome moving at high speeds, the radome can be degraded within a short time. The construction of the radome involves a balance between the electrical properties of the radome and its aerodynamic qualities. This is particularly so when the radome must be able to withstand rain impact at Mach 1 and have the ability to operate with broadband antennae.

A conventional radome made of epoxy impregnated quartz laminated upon epoxy reenforced honeycomb material, for example, has limitations under the environmental conditions noted above. A conventional c-sandwich radome wall made of the materials noted above has been tested on a rotating arm under a controlled rainfall. At a speed of 500 miles per hour, a wall section lasted only 4 minutes with the rain incident at 90° degrees, only 20 minutes with the rain incident at 60 degrees and no damage after 60 minutes with the rain incident at 30 degrees.

A primary handicap contributing to limited rain impact performance is the radome shape needed to satisfy the electrical objective of the contained broadband antenna. Increasing the fineness ratio, length of radome to base diameter, reduces the aerodynamic and rain impact loads; however, streamlining the radome beyond approximately 0.7 causes a negative effect on antenna electrical performance. Another drawback working against rain impact resistance is the inherent brittleness or low impact strength of epoxy resins and of the substrate bond interfaces which encourage the opportunity for delimination. The honeycomb core also obtains its strength by successive dippings into epoxy.

After the core buckels once, causing the epoxy to crack, the compressive strength essentially becomes zero and "soft spots" develop. Any attempt to increase the substrate layer thickness or honeycomb density would decrease the required electrical performance. Realizing the radome shape and material limitations, the task then centers around selecting alternate materials that demonstrate a significant increase in rain impact resistance without sacrificing electrical performance. The primary property used to select an alternate material to maintain similar electrical performance is the dielectric strength.

There currently exists, therefore, a need for a supersonic radome that optimizes electrical properties and aerodynamic qualities under a rainy environment. The present invention is directed toward satisfying that need.

SUMMARY OF THE INVENTION

A radome wall of this invention utilizes a polycarbonate material in the construction of a c-sandwich wall and thereby overcomes the problems set forth hereinabove. The design of the radome wall takes into account electrical properties and aerodynamic properties so as to optimize radar broadband transmissions. One design has an outside skin, an outside core, a center skin, an inside core, and an inside skin composed of polycarbonate bonded together with polyurethane adhesives. The two cores are a plurality of square posts on opposite sides of the center skin. The materials are thermoformed into the desired shape. An alternative design has the same C-sandwich design, but the cores include a plurality of tubes bonded to the skins.

One object of the invention is to provide a radome that can be electrically tuned for minimum reflection of broadband microwave frequencies.

Another object of this invention is to provide for greater resistance to rain erosion over conventional radomes.

Another object of this invention is to provide a radome with reduced layers of material.

A further object of this invention is to provide for a reduction in the cost of materials and production.

A further object of this invention is to provide for radomes having minimum electrical variability due to fewer layers and ease of fabrication; and A still further object of this invention is to provide a radome using principles applicable to other sandwich designs and other multiple layers.

These and many other objects and advantages of the present invention will be readily apparent to one skilled in the art to which the invention pertains from a perusal of the claims and of the following detailed description of a preferred embodiment of the invention when considered in conjunction with the drawings.

DETAILED DESCRIPTION OF A PREFERRED EMBODIMENT

Figure 1:
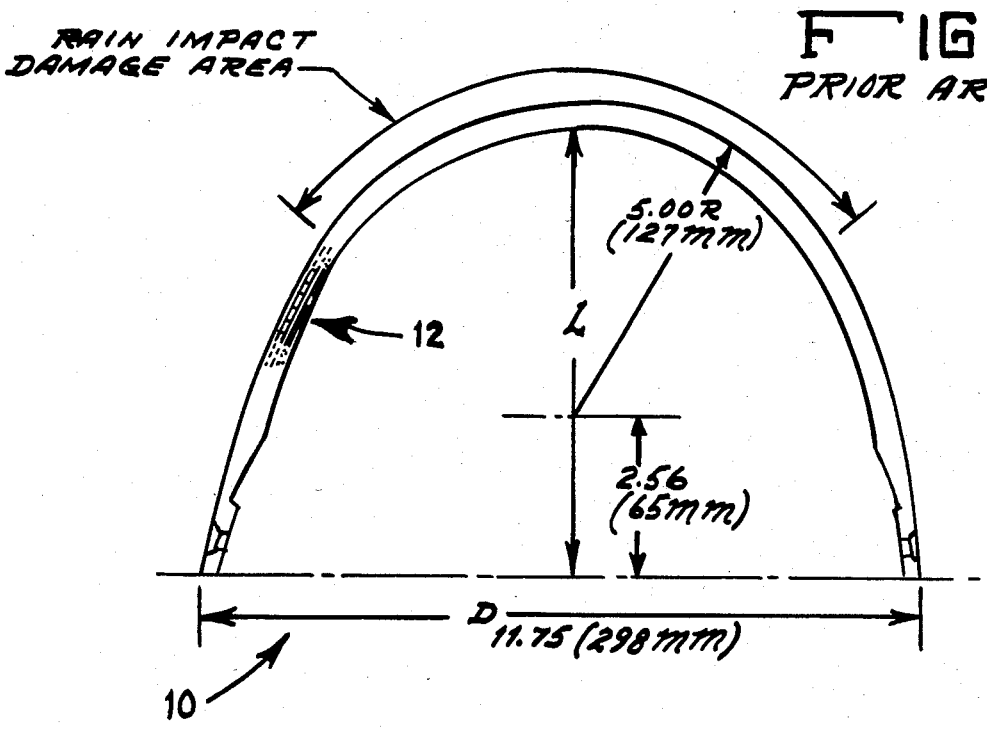
FIG. 1 PRIOR ART
FIG. 1 is a cross-section of a conventional radome showing the rain impact area.
Figure 2:
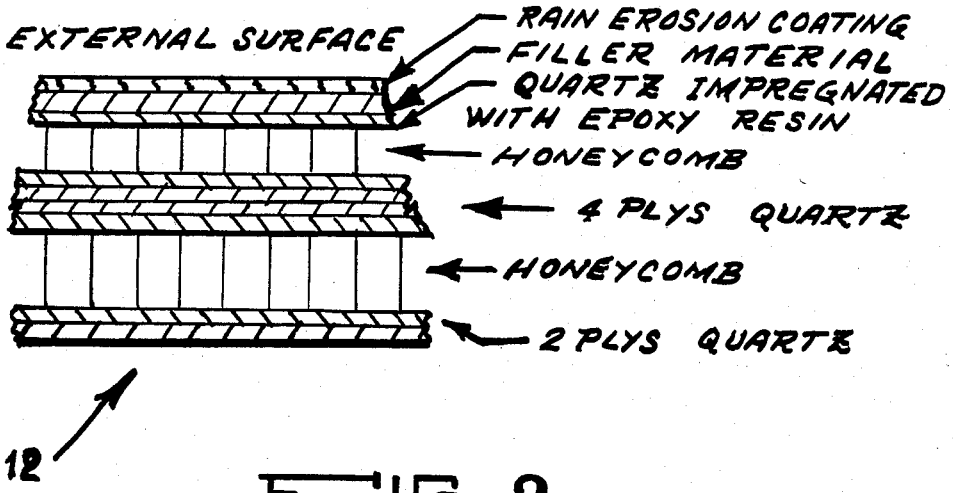
FIG. 2 PRIOR ART
FIG. 2 is a cross-section of a conventional radome wall such as shown in FIG. 1.

For a better understanding of the present invention, reference is initially made to a conventional radome 10 as illustrated in FIGS. 1 and 2 of the drawing in order to more fully comprehend the drawbacks of prior art radomes.

FIG. 1 shows a cross-section of a conventionally shaped radome 10 having a cross-section of wall 12. Wall 12 is shown in greater detail in FIG. 2. A conventional sandwich wall 12 includes layers of epoxy impregnated quartz woven cloth laminated upon epoxy reenforced honeycomb materials. The exterior surface of radome 10 is protected by a coat of polyurethane rain erosion resistant material. The limitations of the prior art design in a rain environment are noted hereinabove. The considerations in the design and selection of materials are also noted hereinabove with further elaboration hereinafter.

In arriving at the present invention, a trade-off between the materials used and antenna performance is required to obtain a radome capable of withstanding continuous rain impact at a constant speed of 500 mph for a minimum of one hour without showing harmful effects. In general thermoplastic materials considered for use in the present invention offer several advantages over conventional glass reinforced radomes using epoxy resins in aircraft applications. Thermoplastics can provide substantial improvements in rain impact resistance without sacrificing electrical performance for multilayer c-sandwich construction used in conjunction with broadband antennas. High temperature thermoplastics can also be selected to meet aerodynamic loads imposed upon blunt-shaped radomes with aircraft velocities in excess of Mach 2.

Figure 3:
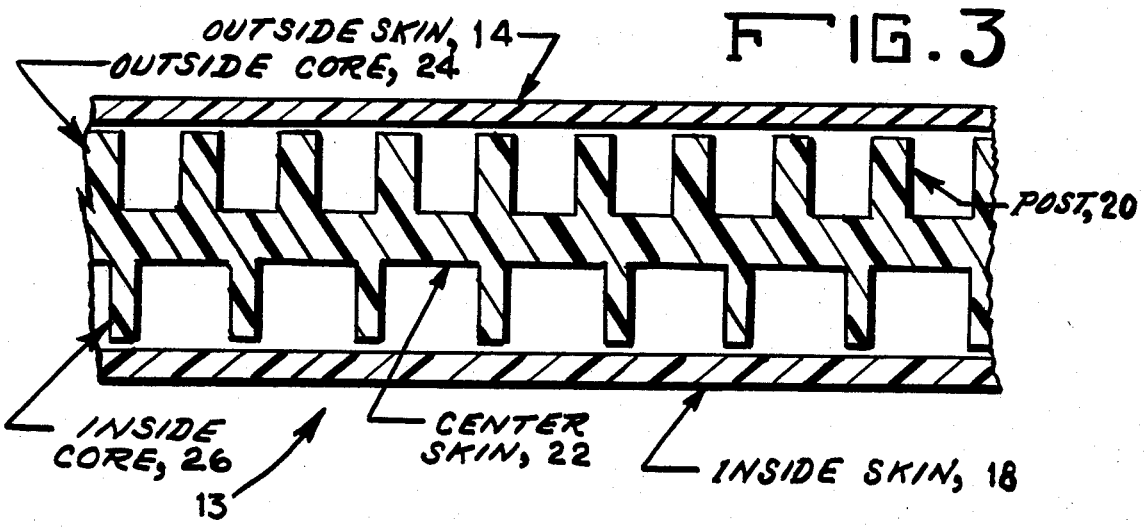
FIG. 3 is a cross-section of a radome wall design of this invention.
Figure 4:
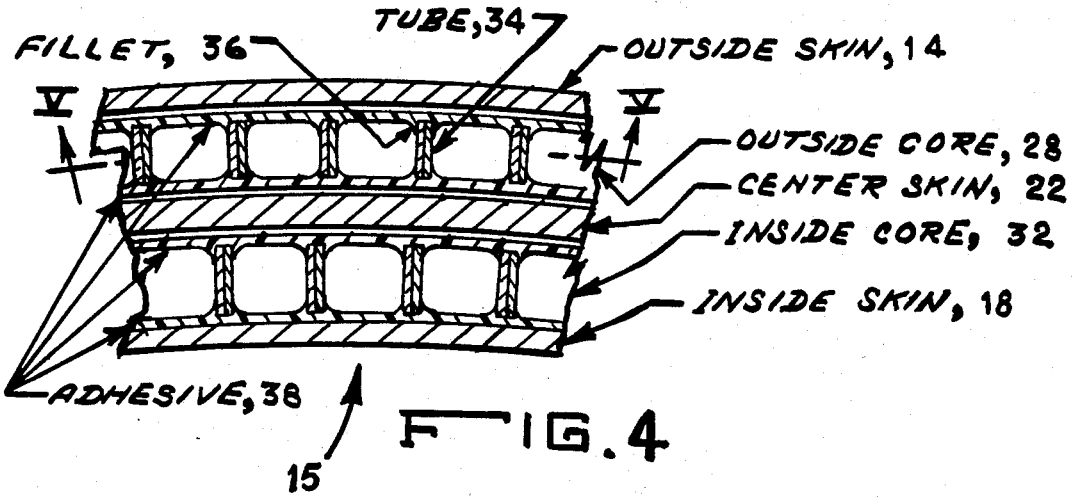
FIG. 4 is a cross-section of an alternative radome wall design of this invention.
Figure 5:
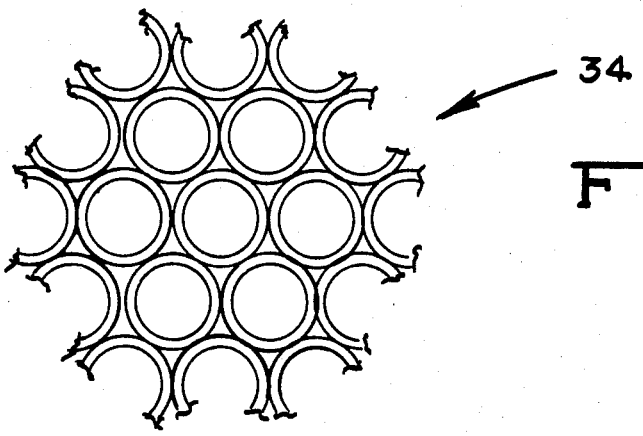
FIG. 5 is a plan view of the core of the alternative wall design of FIG. 4.

The electrical design of a radome wall 13 or 15 shown in FIGS. 3, 4, and 5 consists of tuning candidate thermoplastic laminate configurations and comparing the reflection coefficients against the current epoxy quartz cloth design shown in FIG. 2. A computer program with a plotting subroutine is utilized for this exercise. Various layers and core thicknesses along with the corresponding dielectric constants are entered as parameters for the flat plate analysis. Small perturbations are made with each variable until the reflection coefficient curve of the candidate thermoplastic design corresponds within acceptable limits to the current radome configuration. With each thermoplastic material having a different dielectric constant, there is a different dimensional cross-section that satisfies the electric requirement.

For improved rain impact performance, an outside radome skin 14 and outside cores 24 or 28 should be of maximum thickness and maximum supporting area. These guidelines narrow the candidate laminate configurations for rain impact testing and electrical testing. After further narrowing the candidate designs based upon rain impact results, 6 inch (152 mm) diameter domes are thermoformed and electrically tested to confirm the theoretical analysis. Electrical tests consist of attaching radome walls to waveguides and measuring reflection coefficients, and also attaching to an existing radome (corresponding disc size removed) to measure phase errors. The following Table I illustrates a comparison between the quartz cloth radome of a conventional radome wall 12 and a polycarbonate radome wall 13 or 15 that are of near electrical equivalency.

TABLE I

| | Current Radome | | Polycarbonate Radome | |
|---|---|---|---|---|
| | Thickness | Dielectric | Thickness | Dielectric |
| Rain Erosion Coating | .012 inch | 3.16 | N/A | N/A |
| Outer Skin | .023 inch | 3.40 | .040 inch | 2.76 |
| Outer Core | .132 inch | 1.10 | .120 inch | 1.30 |
| Center Skin | .046 inch | 3.40 | .065 inch | 2.76 |
| Inside Core | .152 inch | 1.10 | .135 inch | 1.14 |
| Inside Skin | .023 inch | 3.40 | .030 inch | 2.76 |

The ability to sustain rain impact and aerodynamic loads imposed by the supersonic aircraft are two important mechanical parameters in designing thermoplastic radome walls 13 and 15. The rain impact goal is to sustain 1.8 mm droplets at a rate of 1 inch (25.4 mm) per hour for a time in excess of 60 minutes. The current quartz cloth radome wall 12 lasts 4 to 5 minutes after which delamination of the outer plies and/or buckeling of the brittle supporting honeycomb occurs. Knowing the aircraft flight profile, the aerodynamic load objective is to sustain a steady state velocity of approximately Mach 1.8. For a flat plate analysis, this velocity corresponds to a stagnation temperature of 123° C. and a dynamic pressure of 23 lbs/in$^2$ (0.16 MPa) at an altitude of 30,000 feet (9.1 km). In addition to the steady state flight requirement of Mach 1.8, there is a high speed dash requirement for a 5 minute duration at Mach 2.0.

Initially, several thermoplastic materials were considered to meet the rain impact requirement. These materials are polyproplene, polycarbonate, polysulfone, polyaralyate and polyetherimide. After demonstrating the rain impact requirement of each material, the materials, polycarbonate and polysulfone, are thermoformed into 6 inch (152 mm) diameter domes, bonded and then subjected to aerodynamic load tests. Out of this exercise, general purpose unfilled polycarbonate was chosen as being able to meet electrical, rain impact and the aerodynamic load requirement.

The core, as determined from the electrical design, is achieved by balancing the correct amount of solid material with air. For example, for an overall outside core dielectric constant (E) of 1.30, a polycarbonate dielectric constant of 2.76 at 10 GHz and a dielectric constant of 1.0 for air, the percentage of solid material is then approximated by the following relationship as shown in Equation I:

$$E_{solid}(\%\ \text{solid})+E_{air}(100-\%\ \text{solid})=E_{overall}(100) \qquad \text{(I)}$$

Substituting the above dielectrics, the percent solid computes to 17% and 83% for air. The percentage of solid material needed for the bottom core is calculated similarly. Knowing the percentage of core solid material within a unit area, the material must provide for maximum outside skin 14 support without thinning the core to the extent of promoting early buckeling of the supporting material. The strength and thickness of outside skin 14 should be considered and balanced against the strength of the chosen core configuration.

Reference is made to FIG. 3 which discloses in cross-section radome wall 13 using the design and the materials of this invention. The same reference numerals will be used in FIGS. 3 and 4 to identify identical elements.

A radome wall 13 of the invention includes an outer skin 14, an outside core 24, center skin 22, an inside core 26, and an inside skin 18. Center skin 22 is connected to a plurality of square posts 20 upon opposite sides of skin 22 as shown in FIG. 3. Skins 14, 18, and 22 and cores 24 and 26 are composed of polycarbonate material. Cores 24 and 26 are attached to skins 14 and 18 by polyurethane adhesives using conventional bonding techniques. Square posts 20 can be machined out of a sheet of polycarbonate leaving center skin 22 therebetween. Wall 13 is shaped into radome 10 using conventional thermoforming techniques.

For wall 13 of this particular design, outside core 24 has 0.050 inch (1.3 mm) square posts 20 on a 0.120 inch (3.0 mm) pitch between posts. This configuration provides an even balance between outside skin 14 strength and center skin 22 strength. In terms of induced rain impact damage, inside core 26 sustains minor damage (if any) in relationship to outside core 24; therefore, inside core 26 does not require a careful strength balance to center skin 22. A compressive buckeling test performed on a square post radome wall 13 and compared against the current epoxy honeycomb construction resulted in square post radome wall 13 buckeling at approximately 1400 lb/in$^2$ (9.7 MPa), whereas the epoxy honeycomb construction buckeled at approximately 800 lb/in$^2$ (5.6 MPa).

As to the rain impact tests, in excess of eighty various c-sandwich thermoplastic configurations were evaluated using the rotating arm apparatus at Wright Patterson AFB, Dayton, OH. Sample speed was generally constant at 500 mph (223 m/sec) with some isolated occurrences up to 600 mph (268 m/sec). In some instances, to increase the data base thus establishing a higher confidence, duplicate samples were tested. Also, at each of the six different test occasions, control samples were evaluated to verify apparatus repeatability, bringing the total number of samples in excess of 110. All thermoplastic test variations were designed to meet a similar electrical performance as current epoxy quartz cloth wall 12 design. The most favorable combination for rain impact resistance consisted of the following: (a) polycarbonate material, (b) 1.30 outside core 24 dielectric, (c) machined posts 20, and (d) polyurethane adhesives. Samples of radome wall 13 repeatedly withstood 60 minutes at 500 mph (223 m/sec); pitting of the external surface was observed at 90 minutes. At 600 mph (268 m/sec), radome wall 13 showed external surface pitting after 20 minutes. In addition to demonstrating improved rain impact performance, an early development test was performed on two 6 inch (152 mm) diameter domes to evaluate the load carrying ability induced by high aircraft speeds. One dome was a polycarbonate laminate and the other was polysulfone. Maximum aerodynamic loads are contained within the blunt shaped 6 inch (152 mm) diameter dome with a 5 inch (127 mm) spherical radius, see FIG. 1. Beyond this diameter, the incident angle diminishes to approximately 8 degrees; hence, the total pressure and temperature are reduced accordingly from a "head-on" condition at the apex to a near parallel flow condition along the sides. A test fixture was used to evaluate the domes during the aerodynamic load test where both increased pressure and temperature are simultaneously induced. This fixture was also used to thermoform the three individual laminate pieces (outside skin, core, inside skin) prior to bonding. To thermoform, the top safety plate was replaced with a machined wooden female mold with a 5 inch (127 mm) spherical radius. The test procedure consisted of maintaining increasing levels of steady state pressure and temperature up to 110° C. and 22 lb/in$^2$ (0.15 MPa). After each temperature and pressure level was maintained at steady state for approximately 30 minutes, the radome was allowed to cool to room ambient conditions for visual and dimensional inspections. Above 100° C. the surface temperature was maintained for 5 minutes to simulate the high speed transient condition. Permanent external skin distortion was noted with the polycarbonate dome after 149° C. and 25 lb/in$^2$ (0.17 MPa). Similar evidence showing the outside skin thermoformed between the dielectric core posts occurred with polysulfone at approximately 177° C. and 28 lb/in$^2$ (0.19 MPa). At these conditions, there was no evidence of catastrophic failure that would effect the aircraft flight performance.

The primary material properties considered in this invention were dielectric constant (electrical), impact resistance (rain erosion) and thermal performance (frictional heating). For the materials under consideration, no material possessed all the desired properties. For example, for minimum dielectric and maximum thermal performance, the rain impact resistance was poor because of the low notched Izod impact strength. A tradeoff in properties was considered in selecting an overall balanced design. Some other factors considered in selecting a material are availability, sunshine resistance, chemical resistance, tensile strength, and the ability to be thermoformed or injection molded. Table II summarizes the material properties reviewed for this development effort. Polyprophylene effort was discontinued early in the development cycle because of its limited heat deflection temperature, 104° C. After careful examination polycarbonate was chosen as the optimum material for this particular radome application.

TABLE II

THERMOPLASTIC - MATERIAL REVIEW

| Generic Name | Poly-carbonate | Poly-sulfone | Poly-arylate | Poly-etherimide |
|---|---|---|---|---|
| Rain Erosion Performance Performance | Excellent | Good | Very Good | Fair |
| Izod Impact (ft-lb/in) Electrical Performance | 12–16 | 1.2 | 4.2 | 1.0 |
| Dielectric Const-Publ | 2.96 at $(10)^6$ Hz | 3.10 at $(10)^6$ | 2.62 at $(10)^6$ | 3.03 at $(10)^3$ |
| Dielectric Const-Meas | — | 2.8 at 30 $(10)^6$ | 2.7 at 30 (10) | 2.9 at 30 $(10)^6$ |
| Thermal Perf, °C. | 132 | 174 | 174 | 204 |
| 152 mm Dia. Dome Results °C. | 154 | 180 | — | — |
| Availability Unannounced | Immed. | Spec. Order | Spec. Order (8 weeks) | |
| Sunshine Resis. UV | Requires Stabilizer | Requires Stabilizer | Excellent | Excellent |
| Chemical Resistance | Good | Good | Good | Excellent |
| Tensile Strength, PSI (MPa) | 8,500 (59) | 10,200 (70) | 9,500 (65) | 15,000 (103) |
| Thermoform Ease | Good | Limited Experience | Uncommon | Unknown |

A similar analysis was performed in determining the optimum bonding agent at the laminate interfaces. To improve the ease of manufacturing, the number of laminate interfaces should be kept to a minimum. Two interfaces are shown in the c-sandwich radome wall 13 design of FIG. 3. Four bonding techniques were evaluated for rain impact resistance: ultrasonic welding, epoxy, acrylic, and polyurethane adhesives. Ultrasonically welded samples lasted approximately 20 minutes at 500 mph (223 m/sec) before the welds separated. Epoxy and acrylic adhesives, which have high tensile and thermal capabilities, failed within ten minutes. The more elastic polyurethane adhesives produced the most favorable test results, lasting in excess of 60 minutes. Polyurethane, the chosen adhesive with a measured dielectric of 3.0, must be carefully applied at each interface in a controlled amount for minimum effect on overall core dielectric. Both surfaces at each interface must be wetted to obtain maximum adhesive strength needed for rain impact strength. Lap shear tests demonstrated polyurethane possesses relatively low values at elevated temperature; however, because the aerodynamic loads were compressive for this particular radome shape there was no bond failure observed in the previously described 6 inch (150 mm) dome temperature test. After the radome c-sandwich wall design was established, effort then centered on fabricating a complete radome. Thermoplastic materials may be either injection molded or thermoformed into the desired shape. Thermoforming was the chosen process for fabricating c-sandwich wall 13. Sheet supplier's manuals were followed for recommended thermoforming technique, and vendors recommendations were also followed for adhesive preparation and curing.

Dielectric cores 24 and 26 and center skin 22 of radome wall 13 are machined from a solid polycarbonate sheet. Grooves are sawed in two directions across the sides, leaving square posts 20 to match the proper dielectric.

The machined outside and inside cores 24 and 26 may be replaced with circular tubes 34 bonded to the skins, but the number of interfaces now becomes four as shown in FIG. 4. FIG. 5 is a cross-section plan view through the tubes of FIG. 4. Circular tubes 34 trademarked as PLASCORE were found suitable in forming the cores of FIGS. 4 and 5. The wall thickness of tubes 34 can be varied to change the dielectric constant thus reducing machining requirements as required in wall 13 design.

Referring to FIG. 4, radome wall 15 is composed of inside skin 18, an inside core 32, a center skin 22, an outer core 28, and outside skin 14. Both outside and inside cores 28 and 32 are constructed of a plurality of tubes 34. Polyurethane adhesive 38 is used to bond the above elements together. Fillet 36 results from such bonding. Thermoforming is also used to fabricate radome tube wall 15 into radome 10. Polycarbonate material is used throughout except for adhesive 38. Table III shows the material used.

TABLE III

| MATERIALS | | |
|---|---|---|
| TYPE | SOURCE | THICKNESS |
| Outside Skin | GE LEXAN 90-30 | 0.038 |
| Outside Core | PLASCORE PC 4M 008 | 0.120 |
| Center Skin | GE LEXAN 90-30 | 0.061 |
| Inside Core | PLASCORE PC 4M 003 | 0.135 |

TABLE III-continued

| MATERIALS | | |
|---|---|---|
| TYPE | SOURCE | THICKNESS |
| Inside Skin | GE LEXAN 90-30 | 0.028 |

Obviously, many modifications and variations of the present invention are possible in light of the above teachings and it is understood that, within the scope of the disclosed inventive concept, the invention may be practiced otherwise than specifically described.

What is claimed is:

1. A radome wall for use in a radome of a supersonic aircraft, said radome being substantially resistant to rain erosion, said radome having a C-sandwich construction, said radome wall comprising:

an outside skin, said outside skin composed of a thermoplastic selected from a group consisting of polyarylate, polycarbonate, polyetherimide, and polysulfone;

a center skin, said center skin composed of said thermoplastic;

an inside skin, said inside skin composed of said thermoplastic;

an outside core between said outside and said center skins, said outside core composed of said thermoplastic;

an inside core between said center and said inside skin, said inside core composed of said thermoplastic and structurally similar to said outside core, said outside and said inside cores comprising a plurality of periodic structures, said structures being posts or tubes and substantially perpendicular to said skins; and an adhesive for bonding said outside skin, said outside core, said center skin, said inside core, and said inside skin together.

2. A radome wall as defined in claim 1 wherein said cores having said posts as said periodic structures are electrically tuned at about 10 GHz to have a dielectric constant in the range of from about 1.14 to about 1.30.

3. A radome wall as defined in claim 1 wherein said cores having said tubes as periodic structures are electrically tuned at about 10 GHz to have a dielectric constant in the range of from about 1.14 to about 1.30.

4. A radome wall for use in a radome of a supersonic aircraft, said radome being substantially resistant to rain erosion, said radome having a A-sandwich construction, said radome wall comprising:

an outside skin, said outside skin composed of a thermoplastic selected from said group consisting of polyarylate, polycarbonate, polyetherimide, and polysulfone;

an inside skin, said inside skin composed of said thermoplastic;

a core between said outside skin and inside skin, said core composed of said thermoplastic, said core comprising a plurality of periodic structures, said structures being posts or tubes and being substantially perpendicular to said skins; and an adhesive for bonding said outside skin, said core, and said inside skin together.

5. A radome wall as defined in claim 4 wherein said core having said posts as said periodic structure is electrically tuned at about 10 GHz to have a dielectric constant in the range of from about 1.14 to 1.30.

6. A radome wall as defined in claim 4 wherein said core having said tubes as said periodic structure is electrically tuned at about 10 GHz to have a dielectric constant in the range of from about 1.14 to 1.30.

* * * * *